United States Patent [19]

Jeter

[11] 4,007,797

[45] Feb. 15, 1977

[54] DEVICE FOR DRILLING A HOLE IN THE SIDE WALL OF A BORE HOLE

[75] Inventor: John D. Jeter, Iowa Park, Tex.

[73] Assignee: Texas Dynamatics, Inc., Dallas, Tex.

[22] Filed: June 4, 1974

[21] Appl. No.: 476,328

[52] U.S. Cl. ..... 175/26; 175/61; 175/81; 173/149

[51] Int. Cl.[2] ..... E21B 7/08

[58] Field of Search ..... 175/61, 62, 26, 94, 175/97–99, 107, 162, 170, 171, 173, 73–83

[56] References Cited

UNITED STATES PATENTS

| | | | |
|---|---|---|---|
| 1,660,999 | 2/1928 | Mac Donell | 175/79 |
| 1,865,853 | 7/1932 | Granville | 175/79 X |
| 2,198,016 | 4/1940 | Rogers et al. | 175/82 |
| 2,258,001 | 10/1941 | Chamberlain | 175/79 X |
| 2,296,161 | 9/1942 | Hall | 175/74 |
| 2,336,338 | 12/1943 | Zublin | 175/75 |
| 2,500,785 | 3/1950 | Arutunoff | 175/78 |
| 2,651,499 | 9/1953 | Zublin | 175/75 |
| 2,726,847 | 12/1955 | McCune et al. | 175/79 X |
| 2,852,230 | 9/1958 | Garrison | 175/82 X |
| 3,797,576 | 3/1974 | Azalbert et al. | 175/61 X |

*Primary Examiner*—Ernest R. Purser
*Assistant Examiner*—Richard E. Favreau

[57] ABSTRACT

The device disclosed includes a housing which can be moved through the bore hole and anchored in the desired location for drilling a lateral hole. Located in the housing is a drill string guide or conductor having a bendable lower end. The conductor is movable to a position where its lower end is either inherently or forceably bent so that it provides a curved path leading toward the side wall of the bore hole. The conductor guides a drill string extending through the conductor to cause the drill string to drill a lateral hole in the side wall of the well bore. The drill string and conductor can be retracted into the housing when the lateral hole has been drilled, or a portion of the drill string may be left in the lateral hole as a drain pipe.

19 Claims, 32 Drawing Figures

25a
25b
21
20
32
28
27
26
THRUST BRG.
22
AXIAL CONTROL
MOTOR
25d
25c
25
22b
24
22c
25e
22a
23
25h
25f
22e
22f
22d
25k
25g
25j
20a
33
36
39
35
34
38
THRUST BEARING
AXIAL CONTROL
MOTOR
25e
22d
22a 51
52
50
53a
53b
59
53
55
54
54c
MOTOR
56
53c
53d
50a
54a
53e
58
53g
54b
53f
53h 50
51
55
58
MOTOR
58
53d
54a
53f 50
51
55
58
50a
54c
MOTOR
53b
56
58
53d
54a
53f

DEVICE FOR DRILLING A HOLE IN THE SIDE WALL OF A BORE HOLE

This invention relates to apparatus for drilling holes extending in a lateral direction from an existing bore hole.

In oil and water wells drilled in the earth, it is often advantageous to drill lateral holes in the subterranean production zone to increase the flow of fluids into the bore hole for subsequent lifting to the earth surface. Lateral holes departing from an existing bore hole are called drain holes and they have received considerable attention in the past. The U.S. Pat. No. 2,667,332 issued Jan. 26, 1954, described apparatus for drain hole work. The apparatus, which later was used in the oil fields, included a flexible drill that was housed in a sheath containing a deflector or whipstock at the lower end. The flexible drill string could bend a limited amount. In operation, the drill string was moved down in the sheath and, encountering the whipstock, deflected into the bore hole wall. After the initial deflection there was no provision to control the direction of the drill after it entered the side wall of the bore hole. Azimuthal orientation accomplishable by the whipstock had no assured lasting effect since the flexible drill string could bend in any direction as the drain hole was being drilled. The manipulation of a massive drill string extending to the earth surface in deep wells resulted in slow drilling and excessive forces on the down hole equipment.

Since drain holes can be expected to extend a relatively short distance from the bore hole compared with the length of the ordinary drill string in relatively deep wells, it is desirable to limit the mechanical forces required of the conventional drill string and provide for much higher speed of operation of the short lateral drill string than can be safely expected from the manipulating drill string extending to the earth surface.

Since low points in drain holes tend to sludge up and become obstructed in time, it is desirable to achieve full preselected deflection of the drain hole from the existing bore hole axis, preferably above the horizontal, in a minimum of distance drilled from the bore hole. This increases the velocity of production fluids at the low points and retards the development of obstructions.

It is therefore, an object of this invention to provide a device for drilling a lateral hole from an existing vertical or non vertical bore hole at a preselected angle to the longitudinal axis of the bore hole.

It is another object of this invention to provide a device to drill a hole in a bore hole side wall that provides a guide for the drill string that extends into the side wall to direct the drill string in the desired direction.

It is another object of this invention to provide a device to drill a hole in a bore hole side wall that provides a guide for the drill string that extends into the side wall, the guide bending to a preselected curvature as it extends from the bore hole into the side wall and further having means to drill a hole into the side wall which the extending guide may occupy as it guides a drill string that drills a continuing lateral hole into the earth.

It is another object of this invention to provide a flexible lateral drill string that will bend as required to pass through a curved guide but which will tend to remain straight as it drills laterally into the earth beyond the guide.

It is another object of this invention to provide a device to bend rigid pipe as it is moved from a position parallel to the axis of the bore hole for insertion laterally into the earth.

It is another object of this invention to provide a rigid drill pipe which may be bent as it is moved from a position parallel to the axis of the bore hole for insertion laterally into the earth which may be left in the lateral hole as a drain tube.

It is another object of this invention to provide a device to automatically sequence the extension of the curved guide, the extension of the lateral drill string to drill a lateral hole and the retraction of the guide and drill string so that communication of control activities from the earth surface down the bore hole is minimized.

These and other objects, advantages, and features of this invention will be apparent to those skilled in the art from a consideration of this specification, including the attached drawings and appended claims.

BRIEF DESCRIPTION OF DRAWINGS

In the drawings, wherein like reference characters are used throughout to designate like parts.

DETAILED DESCRIPTION OF DRAWINGS

Figure 1:
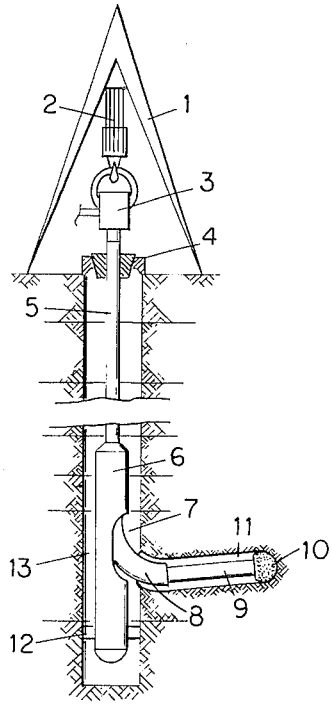
FIG. 1 is a view in elevation of the device of this invention drilling a lateral hole in the side wall of a well bore.

In FIG. 1 a general schematic of a drilling rig is shown with the device of the invention in operation to drill a lateral hole 11 from a generally vertical previously drilled well bore 13. The drilling rig structure 1 supports the drill string 5. Hoist gear 2 moves the drill string vertically within the bore hole. The rotary table 4 as in conventional practice can rotate the drill string 5 and position the drill string in any azimuthal position using any available procedure.

The preferred embodiment of the side wall drilling device of this invention includes housing 6 attached to drill string 5 and the device can be moved axially in the well bore and can be positioned in azimuth by rotating the drill string. Drill string 5 will be referred to as the manipulating drill string in the balance of the description. The housing has a lateral opening 7. A bendable drill string conductor 8 is shown to have completed its movement from the housing out the opening along a preselected curved path to and into the formation to guide and protect the lateral drill string 9 as it is thrust in a straight line from the guide into the earth. Drill bit 10 carried by the lateral drill string drills lateral hole 11 as the drill string is rotated and advanced out of the guide. Anchors 12 extend from housing 6 to engage the bore hole side wall when, as will be explained below, drilling fluid pressure is applied down the bore of the manipulation drill string. When the flow of drilling fluid is stopped, the anchors retract into the housing. Drilling fluid flowing down the manipulation drill string flows through the various parts of the device of the invention in a manner to be described later, through the lateral drill string 9, out openings in the drill bit 10, to return along annulus 11 of the lateral hole, into the annulus 13 of the well bore and returns to the earth surface.

Figures 2, 3, 4:
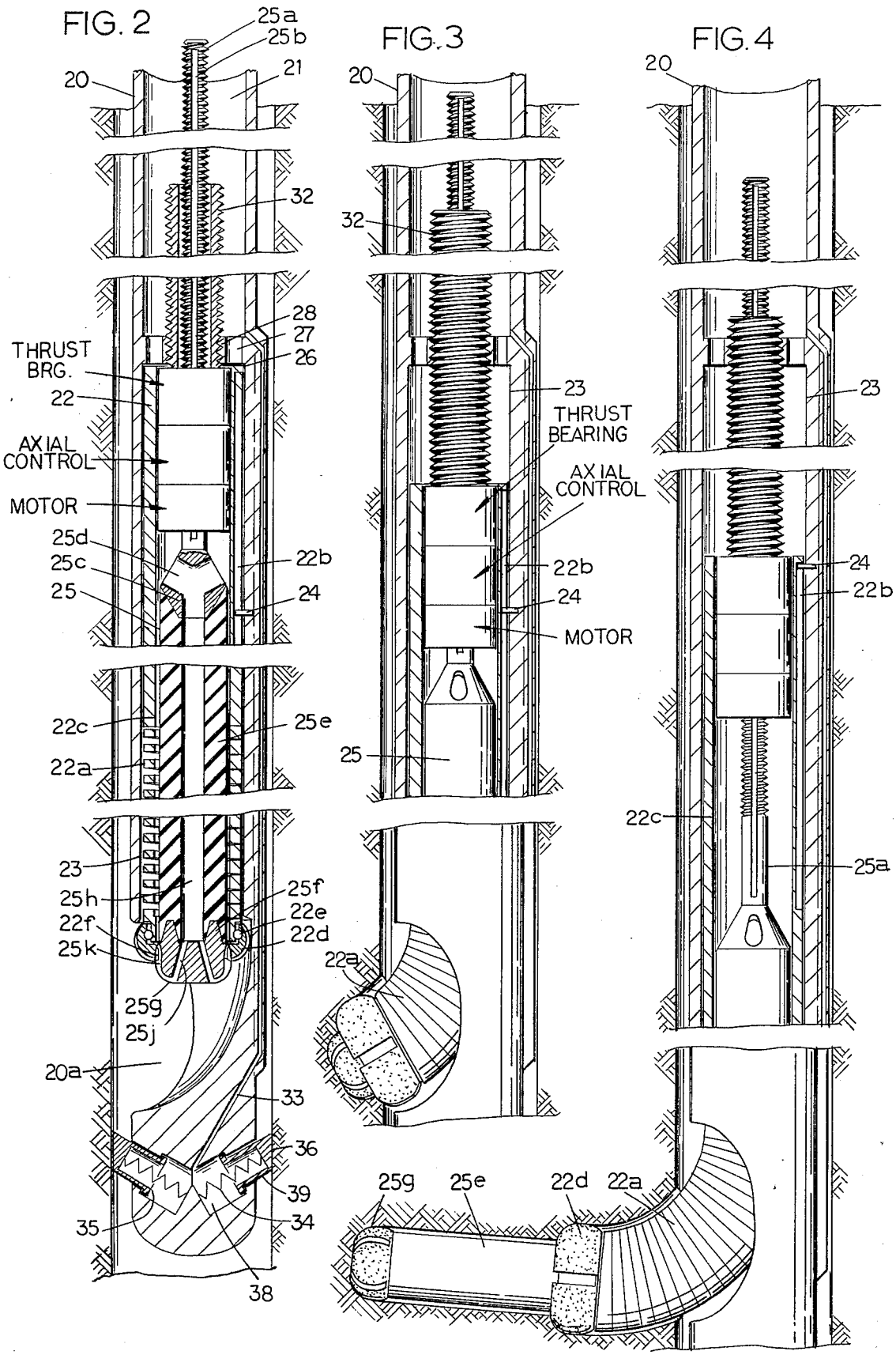
FIG. 2 is a longitudinal sectional view of the preferred embodiment of the lateral drilling device of this invention with the drilling extensions retracted for movement within a bore hole for transport.
FIG. 3 is a view partly in section and partly in elevation of the device of FIG. 2 as it begins to drill a curved hole in the bore hole side wall to accept the bendable conductor.
FIG. 4 is a view partly in section and partly in elevation of the device of FIG. 2 with the bendable conductor having completed its planned penetration into the side wall and the lateral drill string just beginning its penetration farther into the earth.

Referring now to FIG. 2, the top of housing 20 is attached by threaded connection (not shown) to a manipulation drill string. Drilling fluid moving down the bore of the manipulation drill string flows down bore 21 of housing 20 through ports 27, through the thrust bearing, axial control and motor, by channels shown in FIG. 29, into the lateral drill string openings 25*d*, along the bore 25*h* and out openings 25*j* of lateral drill bit 25*g*. The device of FIG. 2 is shown with all drilling extensions in the fully retracted position as the device is normally transported and moved within the well bore.

To actuate the device, drilling fluid is pumped down the drill pipe. The pressure of the fluid in bore 21 of the housing is transmitted through duct 33 into cylinders 38 to create a pressure differential across pistons 35, and urge anchors 39 into the bore hole side wall as shown at point 36. The drilling fluid also causes the motor to rotate lateral drill string 25. The drill bit 25*g* is attached to the lower end of the lateral drill string and rotates with it. Because bit 25*g* is nested within the conductor drill bit 22*d* and lugs 22*f* of the bit 22*d* fit into the channels 25*k* of bit 25*g*, the bit 25*g* and bit 22*d* rotate in unison. The bit 22*d* is rotably mounted on the lower end of the bendable conductor extension 22*a* by bearings 22*e*. The flexible lateral drill string extension 25*e* has end fittings 25*f* and 25*c*. Fitting 25*f* is shown as part of the drill bit 25*g*.

The bendable lateral drill string conductor extension 22*a* is prebent to the desired curvature and if not constrained will inherently return to its prebent curved condition. In FIG. 2 the bendable extension 22*a* of the conductor is held straight in the bore 23 of housing 20. The conductor 22 has an axially directed groove 22*b* in its outer surfce. A pin 24 affixed to housing 20 is slidably situated in the groove. The conductor, therefore, can move axially in bore 23 but cannot rotate relative thereto. The conductor 22 is oriented in rotation relative to housing 20 so that the inherent curve of the bendable extension 22*a* will curve out of opening 20*a* when the extension 22*a* is free of the constraint of bore 23.

When the lateral drill string is rotated by the motor, the axial control, the operation of which will be explained in detail below, causes the screw 32 to rotate at a slower speed. When the screw rotates, threads 28 in housing 20 cause the screw to move down. The upper end of the lateral drill string 25 is a threaded rod 25*a*. A keyway 25*b* extends the length of rod 25*a* down to and through the bore (described in detail later) of the motor.

With the drill bits 25*g* and 22*d* rotating, the screw 32 first is rotated a preselected number of turns. This moves conductor 22 a preselected distance down in bore 23 allowing the bendable extension 22*a* to move out of opening 20*a*. The drill bits 25*g* and 22*d* contact the bore hole side wall as shown in FIG. 3, and drill a hole. The bendable extension 22*a*, having an inherent radius of curvature, bends through an angle relative to the housing axis that is proportional to the distance the thrust bearing is moved downward by screw 32. When the desired angle of departure from the bore hole axis is achieved by the extension 22*a*, the rotation of the screw 32 is stopped. The axial control then causes the rod 25*a* to begin to move down and this urges the lateral drill string flexible extension 25*e* to move through the curved bore of the bent extension 22*a*. As shown in FIG. 4, the bit 25*g* moves out of the nesting position in bit 22*d* and drills into the earth. The bit 22*d*, having drilled an access hole for the conductor extension 22*a*, is no longer driven in rotation by bit 25*g* and it stops rotating. When the lateral drill string has moved the desired distance into the earth, the axial control reverses the axial motion of rod 25*a* and the lateral drill string is moved back to the starting position relative to the conductor 22. Axial motion of rod 25*a* is then stopped and screw 32 is rotated in reverse to retract the conductor extension 22*a* back into the bore 23 of housing 20. When the upper end of conductor 22 is at the upper limit of travel it partly covers the ports 27 and an increase in resistance to the flow of drilling fluid through the ports can be detected at the earth surface to signal the completion of the drilling cycle. The rotation of screw 32 is stopped. The operator at the earth surface, being aware of the completion of the drilling cycle, can stop the flow of drilling fluid down the manipulation drill string. This reduces the pressure in bore 21 and channel 33. The springs 34 retract pistons 35 releasing bore hole anchors 39.

Figure 29:
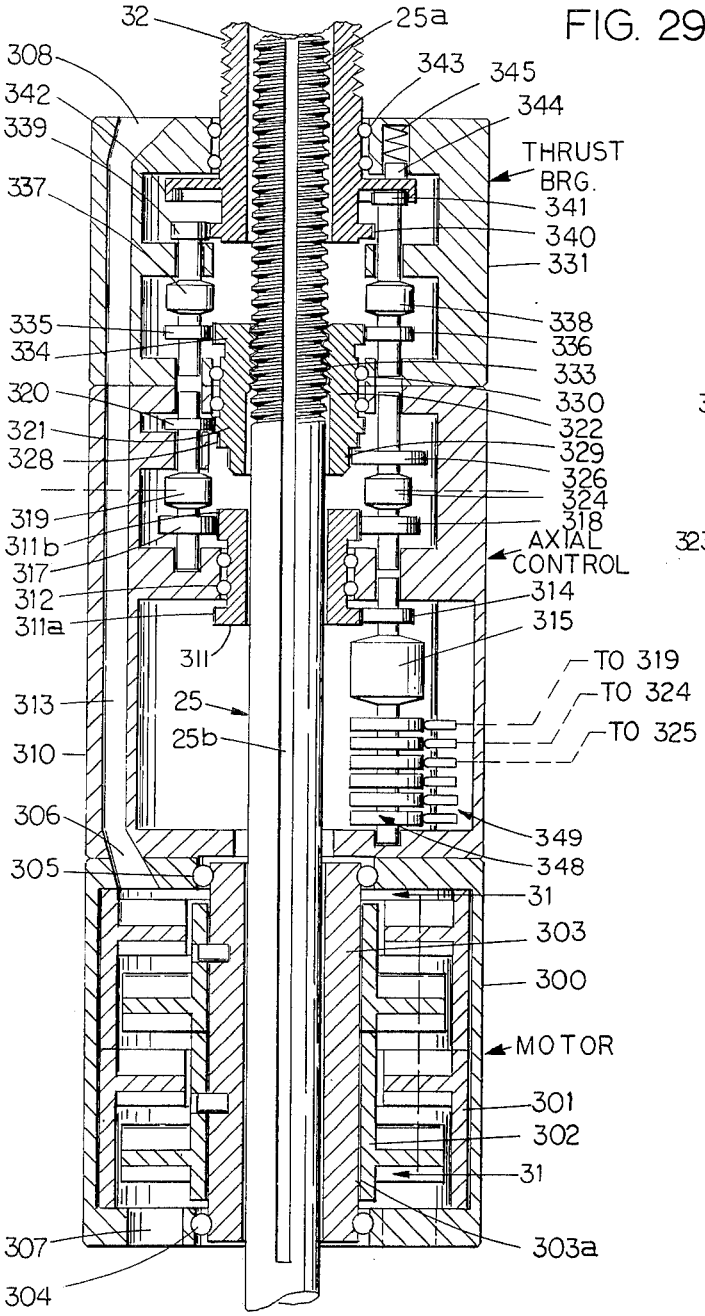
FIG. 29 is a view partly in section and partly in elevation of the motor, axial control and thrust bearing of FIG. 2.
Figure 30:
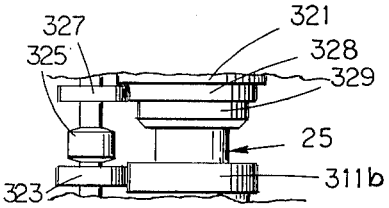
FIG. 30 is a side view in elevation of gearing of FIG. 29 with the case broken away.
Figure 31:
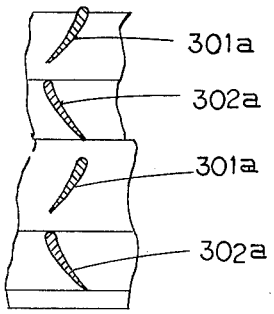
FIG. 31 is a sectional view of the blades of the motor of FIG. 29 taken along line 31—31.

Details of the construction of the motor, axial control and thrust bearing will be described with reference to FIGS. 29, 30 and 31. The apparatus shown by FIG. 29 includes a thrust bearing, axial control and a motor. The housings of all three are affixed within the upper end of the conductor 22 of FIG. 2 to prevent motion relative thereto. Members common to both FIG. 2 and FIG. 29 have the same reference numbers.

The motor consists of motor housing 300, stator 301, which is constrained against motion within the motor housing, rotor 302 and tube 303. The lateral drill string rod 25*a* extends slidably through the bore of rotor tube 303. The tube 303 has a key (not shown) to engage keyway 25*b* to prevent relative rotation between the rod 25*a* and the tube 303. Bearings 304 and 305 axially constrain the tube 303 within the motor housing and allow the tube to rotate. The drilling fluid acts upon turbine blades to rotate the rotor and enters the motor through openings 306 at the top and exists through ports 307 at the bottom. Rotor blades are shown in FIG. 31 as 302*a*, the stator blades as 301*a*.

The axial control includes housing 310 and collar 311 which is axially constrained by bearings 312 by which the collar rotates with rod 25*a*. Collar 311 has a key (not shown) which secures collar 311 to the rod 25*a* against relative rotation by slidably engaging keyway 25*b*. The rod is free to slide axially within the collar bore. The collar 311 has a gear 311*b* on the top end and gear 311*a* on the bottom end.

Drilling fluid enters port 308, flows along duct 313, through opening 306 and causes the rotor and hence tube 303 to rotate. This causes rod 25*a* to rotate. The rotation of rod 25*a* causes collar 311 to rotate because the two are slidably keyed together. The gear 311*a* rotates because it is part of collar 311. In mesh with gear 311*a* is gear 314 which rotates as gear 311*a* rotates and, in turn, rotates the input shaft of the speed reducer 315. The speed reducer drives the cam cluster 348. The cam follower cluster 349 is used by means of linkages not shown to operate the control clutches.

Gears 317, 323 and 318 are in mesh with gear 311*b* and hence rotate when rod 25*a* rotates. Gear 317 rotates the input shaft of clutch 319. Gear 318 drives the input shaft of clutch 324 and gear 323 drives the input shaft to clutch 325. When clutch 319 is engaged it drives gear 320. When clutch 324 is engaged it drives gear 326, and when clutch 325 is engaged it drives gear 327.

The gear nut 322 has integral gears 321, 328 and 329, and is rotably mounted to the thrust bearing case 331 by bearings 330. The nut 322 also has internal threads 333 which engage the threads of the rod 25*a*. The gear ratios are such that when clutch 325 is engaged, gear 327 drives the gear 328 at the same rotational speed as gear 311*b*. When clutch 319 is engaged, gear 320 drives gear 321 slower than gear 311*b* and when clutch 324 is engaged, gear 326 drives gear 329 faster than gear 311*b*. Obviously only one of the clutches 319, 324 and 325 can be engaged at any one time. The cam cluster 348 and cam follower cluster 349 control the clutches and are so synchronized that one of the clutches 319, 324 and 325, but only one, will always be engaged.

With the rod 25*a* rotating counterclockwise as viewed from the top, then, with clutch 319 engaged and nut 322 rotating more slowly than the rod, the rod will move downward relative to the nut. With clutch 325 engaged and the nut rotating at the same speed as the rod, the rod will be axially stationary. With clutch 325 engaged and the nut rotating faster than the rod, the rod will move upward relative to the nut.

Since nut 322 always rotates when the rod 25*a* rotates, it has integral gear 334 at the top within the apparatus called a thrust bearing and is used to drive screw 32. Gear 334 drives the gears 335 and 336. Gear 335 drives the input to clutch 337 and gear 336 drives the input shaft to clutch 338. Clutch 337, when engaged, drives the screw 32 in the direction of rod 25*a* by means of gear 339 which meshes with gear 340 on the screw. This moves screw 32 downward due to the nature of threads on screw 32 in conjunction with the mating threads 28 in housing 20 of FIG. 2. Clutch 338, when engaged, reverses the direction of rotation of screw 32 by means of gear 341 in mesh with internal gear 342 which is attached to screw 32. Obviously both clutches 337 and 338 cannot be simultaneously engaged, but in this case both are sometimes disengaged. When screw 32 is not being driven in rotation it is held stationary by drag brake 344 urged into contact with the web of gear 342 by spring 345. The screw 32 is rotably mounted for axial constraint relative to case 331 by bearing 343.

From the foregoing it can be seen that the axial control accomplishes preselected axial motions of the conductor 22 and lateral drill string 25 of FIG. 2 which can be automatically carried out by selecting appropriate cams for the cam cluster. Actuating means enabling the cam followers to control the clutches are well known in the art and hence not shown in detail. In practice, the cam followers may well be spring loaded valve actuators which in turn control the convenient drilling fluid pressure in ductwork serving clutch actuators.

It may be preferred to use multi-conductor wire line extending down the manipulation drill string bore from the earth surface to control the action of the device of this invention. Such wire lines are commonplace on larger drilling installations for well logging and survey work. The clutches may then be solenoid actuated, each energised by a separate circuit or by a multiplexing arrangement. Such circuitry and controls are in the art, not themselves considered invention as applied here, and hence not shown in detail.

The preferred sequencing operations will be described. Beginning with the conductor and lateral drill string retracted as shown in FIG. 2, the operator at the earth surface, when ready to drill a lateral hole, will activate pumps to start a flow of drilling fluid down the bore of the manipulation drill string. As previously described, the anchors 39 move into side wall engagement to stabilize the device to prevent motion within the bore hole during drilling. The motor will begin to rotate and the cam cluster will engage clutch 325 to hold the lateral drill string axially stationary within the conductor 22. Clutch 337 will be engaged and screw 32 will rotate to move conductor 22 and drill string 25 downward in unison in the bore 23 of body 20. After a preselected number of turns of screw 32, having moved the conductor a preselected distance, clutch 337 will be disengaged and screw 32 will be held stationary by drag brake 344. Clutch 325 will be disengaged and clutch 319 will be engaged simultaneously and the rod 25*a* will move downward to extend the lateral drill. After a preselected number of turns, the rod 25*a* will have moved a preselected distance because of the fixed ratio of the gear trains including gears 311*b*, 317, and 321. The cam cluster syncronized to the number of turns desired will simultaneously disengage clutch 319 and engage clutch 324. As previously described this reverses the axial direction of the movement of rod 25*a* and the lateral drill string is retracted from the earth back to the starting position within the conductor 22. When the retraction of the lateral drill string is complete which again will represent a specific number of turns of rod 25*a*, the cam cluster will simultaneously disengage clutch 324 and engage clutch 325 and also engage clutch 338. This stops retraction of the lateral drill string relative to the conductor and starts the retraction of the conductor from the lateral hole back into the housing. The conductor and lateral drill string, being axially locked together by the gear nut, retracts in unison.

When the conductor is retracted to the starting position in the housing, clutch 338 will be disengaged and the drag brake will hold the stopped screw 32 in position. The cam cluster will preferably include a period of time in the starting position as represented by a number of turns of the rod 25*a* so that the pressure rise caused by the partial interference of ports 27 by the top of conductor 22 at full retraction will have time to reach the earth surface and allow operator reaction time. If drilling fluid flow is not stopped, after a preselected number of turns, the device will again go through the aforementioned drilling cycle. Normally the device will be moved within the bore hole so that the next cycle will make a new lateral hole.

Figures 5, 6, 7:
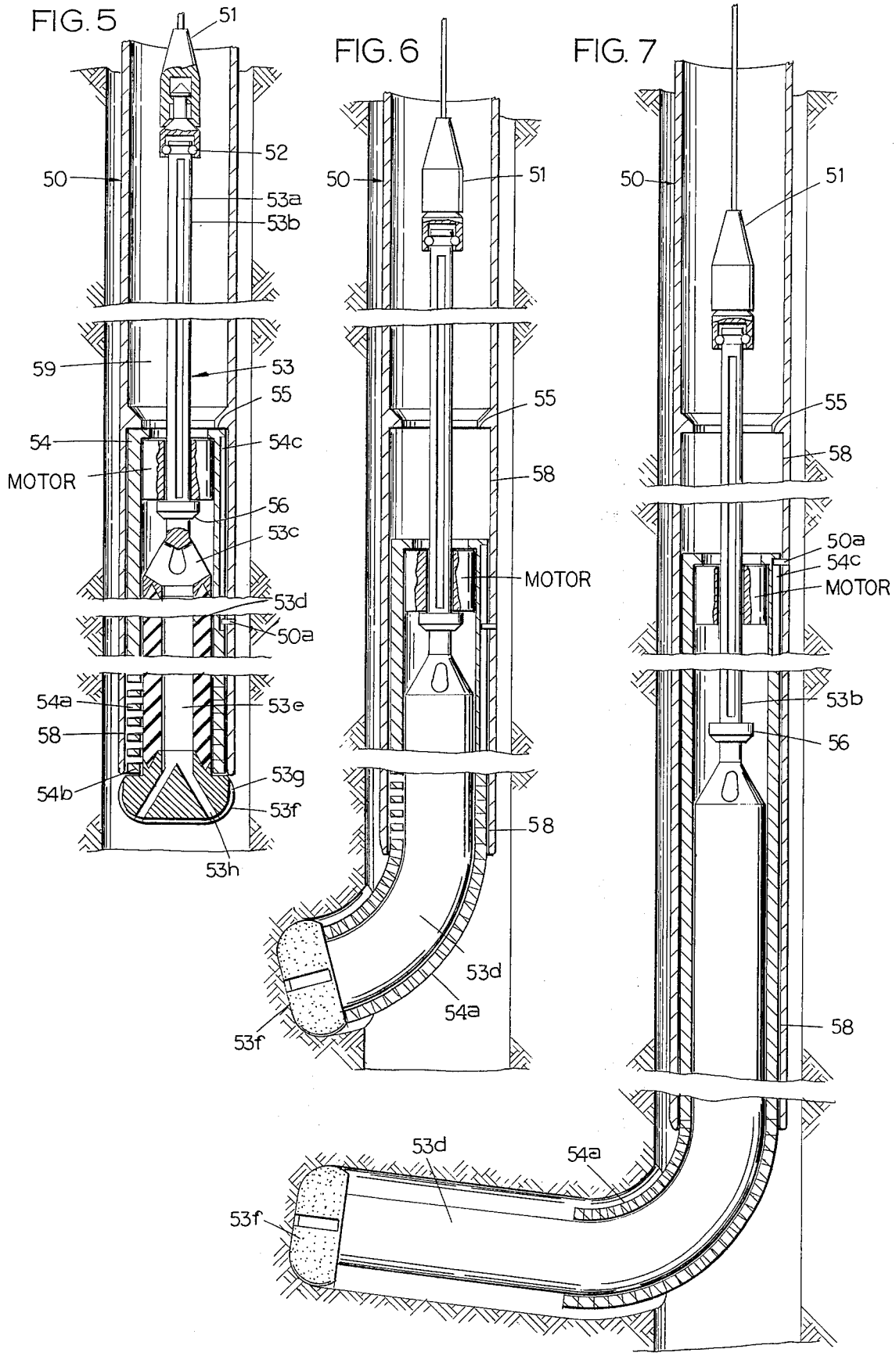
FIG. 5 is a longitudinal sectional view of an alternate embodiment of the device of this invention.
FIG. 6 is a view partly in section and partly in elevation of the device of FIG. 5 as lateral drilling begins.
FIG. 7 is a view partly in section and partly in elevation of the device of FIG. 5 as deflection is completed and a straight lateral hole is being drilled.

The device of FIGS. 5, 6 and 7 is a simpler embodiment more useful in shallow wells. Housing 50 is attached to a manipulation drill string through the bore of which tension string (or wire line) 51 is suspended. Tension string 51 is axially controllable from the earth surface and is attached to lateral drill string 53 by swivel 52, allowing string 53 to rotate relative to tension string 51. Housing 50 has a lower cylindrical bore 58 into which bendable conductor 54 is slidably situated. Lateral drill string 53 has upper shaft 53*b* free to slide axially through the bore of the motor (same motor as in FIG. 29) but rotationally connected by keyway 53*a* in shaft 53*b* and a key (not shown) in the bore of motor 57. String 53 is limited in upward travel by flange 56 on shaft 53*b* which abuts motor 57 on the lower side. Motor 57 is axially and rotationally fixed to conductor 54. When shaft 53*b* is lifted by string 51, flange 56 lifts motor 57 which, in turn, lifts conductor 54 until the conductor hits abutment 55 in housing 50. At the upper limit of travel of conductor 54, the bendable portion 54*a* is forced straight into bore 56 of housing 50. The string 53 is of such dimensions that, at this upper travel limit with shoulder 56 against motor 57, drill bit 53*f* will be lifted into the guide bore 54*b* of conductor 54 where it can rotate relative to the conductor. If the drill bit 53 is now rotated, it will behave as a bit rotatably attached to the end of conductor 54.

When drilling fluid circulation is started, pressure will rise in bore 59 and the pressure drop through motor 57 acting as a piston will cause conductor 54 to be urged downward. Motor 57 will rotate, rotating string 53 including bit 53*f.* Fluid emerging from the lower end of motor 57 will enter opening 53*c* and continue down bore 53*e* and emerge from drill bit opening 53*h*.

As tension string 51 is lowered from the surface, conductor 54 and string 53 move down as a unit. Conductor 54 has longitudinal groove 54*c* which engages pin 50*a* in housing 50. This groove and pin arrangement prevents rotation of conductor 54 within housing 50 and limits axial travel of the conductor within the housing. The lower end 54*a* of conductor 54 is a helical spring which when not forcefully distorted is inherently curved along its longitudinal axis. As spring 54*a* emerges from bore 58 it does so along a curved line. Since drill bit 53*f* is held axially into the pilot 54*b* of conductor 54, and is rotating, the bit drills a path in the formation for spring 54*a* to follow as shown in FIG. 6. When pin 50*a* reaches the limit of travel of groove 54*c*, conductor 54 stops moving. It is curved in a preselected arc.

As lowering of tension string 51 continues, drill string 53, urged downward by its weight and the drilling fluid pressure, progresses downward through the bore of conductor 54, around the curve of the spring 54*a* and into the formation. The drill string extension 53*d* is flexible but is urged straight by internal fluid pressure and internal stiffeners yet to be described. Lateral drill string extension 53*d* then tends to continue straight into the formation in the direction achieved by conductor extension 54*a* at the time its axial movement was stopped. Drill bit 53*f*, being attached to drill string 53, leaves the pilot end of extension 54*a*.

When a lateral hole has been drilled, tension string 51 is lifted and lateral drill string 53 begins to withdraw from the formation. As flange 56 hits motor 57, the conductor 54 begins to be withdrawn into bore 58 of housing 50 forcing the extension 54*a* into straightness. The device may be repositioned in the bore hole or removed and transported elsewhere.

It is obvious that the tension string 51 may be a shaft rigidly connected to lateral drill string 53 and serve both the vertical control function and the rotational function, eliminating motor 57. This rigid tension string would lend itself to drive and control by powered swivels common to workover rigs. Since drilling fluid is normally pumped through powered swivels, shaft 53*b* may be made hollow and openings 53*c* eliminated. A hydraulic seal and thrust bearing would replace motor 57. The drilling cycle would be as explained above.

Figure 8:
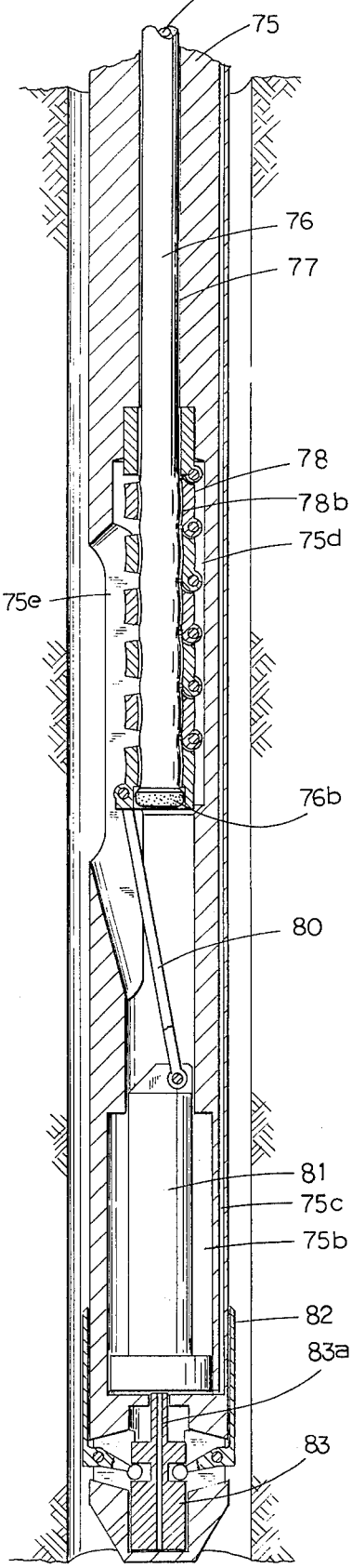
FIG. 8 is a view partly in section and partly in elevation of an alternate embodiment of the device of this invention as it would be transported and moved within a bore hole.

The device of FIG. 8 is adaptable for use in large or underreamed bore holes. Housing 75 has longitudinal opening 77 through which lateral drill string 76 extends. Bendable conductor 78 hangs in recess 75*d* held straight by link 80 connected to hydraulic ram 81. In this situation the device is transported and positioned.

Figure 9:
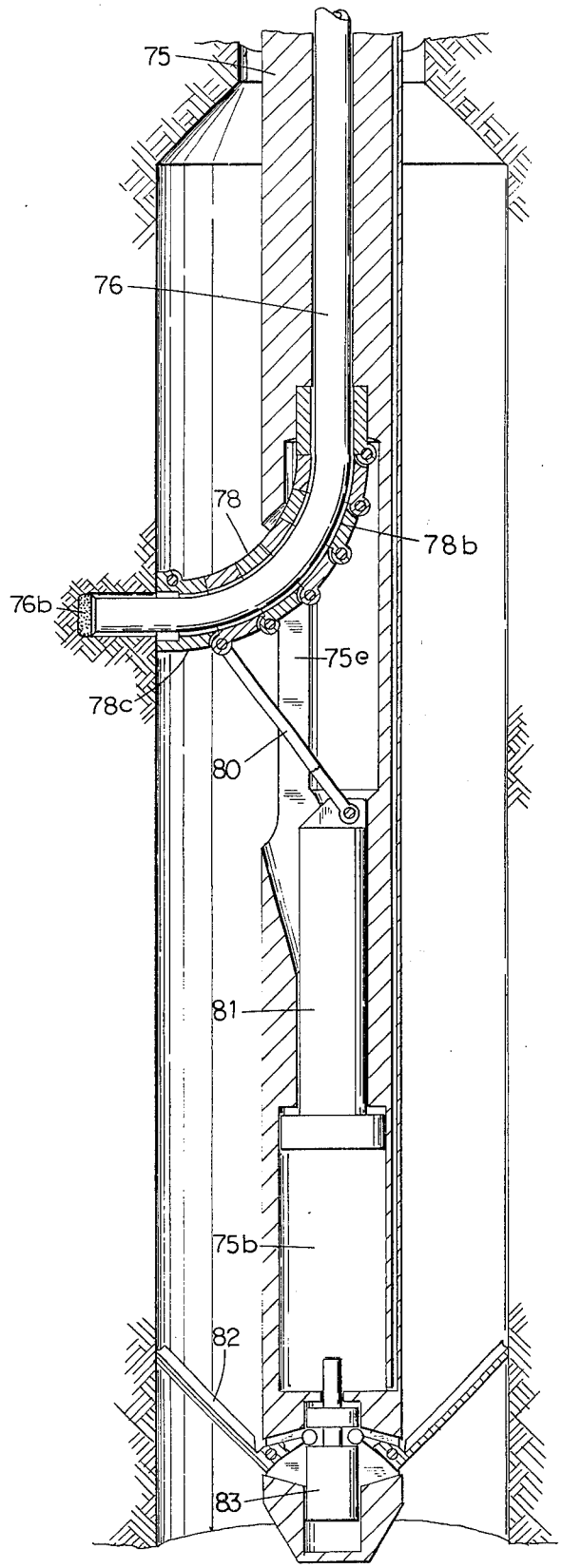
FIG. 9 is a view partly in section and partly in elevation of the device of FIG. 8 as it is deployed in an underreamed bore hole.

When drilling is to begin, drilling fluid is pumped from the earth surface, through a connecting means and into the bore 76*a* and opening 77. Above the device (not shown) channel 75*c* opens into common communication with opening 77, hence pressure stands in channel 75*c* as drilling begins. Channel 75*c* admits fluid under pressure below ram 81. The ram rises, urging link 80 upward. The conductor 78, being hinged on the right side, and link 80, hinged to the conductor on the left, causes the conductor to bend at each link, the whole curving into an arc as shown in FIG. 9 and extending out of housing 75 through side opening 75*e*. The conductor links have limited hinge travel and rotate about the hinge pins a specific amount forming the desired total curve of conductor 78.

As fluid pressure builds below ram 81, it flows through opening 83*a*, through ram 83 to a closed region below ram 83, forcing the ram upward. Ram 83 is connected to anchors 82 through linkages so that the upward movement of the ram causes the anchors to extend to the access hole side wall and secure housing 75 in position.

Drilling is accomplished by rotating lateral drill string 76 and lowering the drill string into the housing 75. Rotation and lowering may be accomplished by the hereinbefore described means. The drill string progresses down opening 77, around the opening in conductor 78 shown as 78*b*, and to and into the formation. A hole is drilled in the formation because drill bit 76*b* is attached to string 76 and rotates with the string and transmits the axial thrust of the string to the formation. Drilling is enhanced by fluid moving down bore 76*a* and emerging through the bit in conventional manner to cool the cutting structure and remove cuttings from the hole.

The bit 76*b* is shown too large to pass upward through the bore 78*b*. The bit could not be lifted upward through the conductor. This situation is likely to be commonly used. The bit 76*b* can be made smaller than bore 78*b* and the lateral string in its entirety may be lifted out of the device, and, if desirable, completely out of the well for bit replacement or other reasons.

It is possible to force rigid pipe down opening 77 where it will bend and progress around opening 78*b* and approach the formation. In soft formations fluid moving through the bore of string 76 (a rigid pipe in such cases) will cut a path along which string 76 may progress. Normally such a pipe emerging from the end of conductor 78 would remain curved and would not progress far into the formation in a predictable manner. The extended end of conductor 78 shown as 78*c* has a reverse bend if used with a rigid pipe to straighten the string 76 as it emerges from the conductor so that a straight lateral hole may then be produced. An appropriate reverse bend is shown as element 102*c* in FIG. 10. In harder formations the drill bit 76*b* may be driven by a motor so that it may drill without rotating the pipe bent into a curve. The drill string 76 may be left in the formation as a drain tube and may be perforated as in FIGS. 22A and 22B to be subsequently described.

Figure 10:
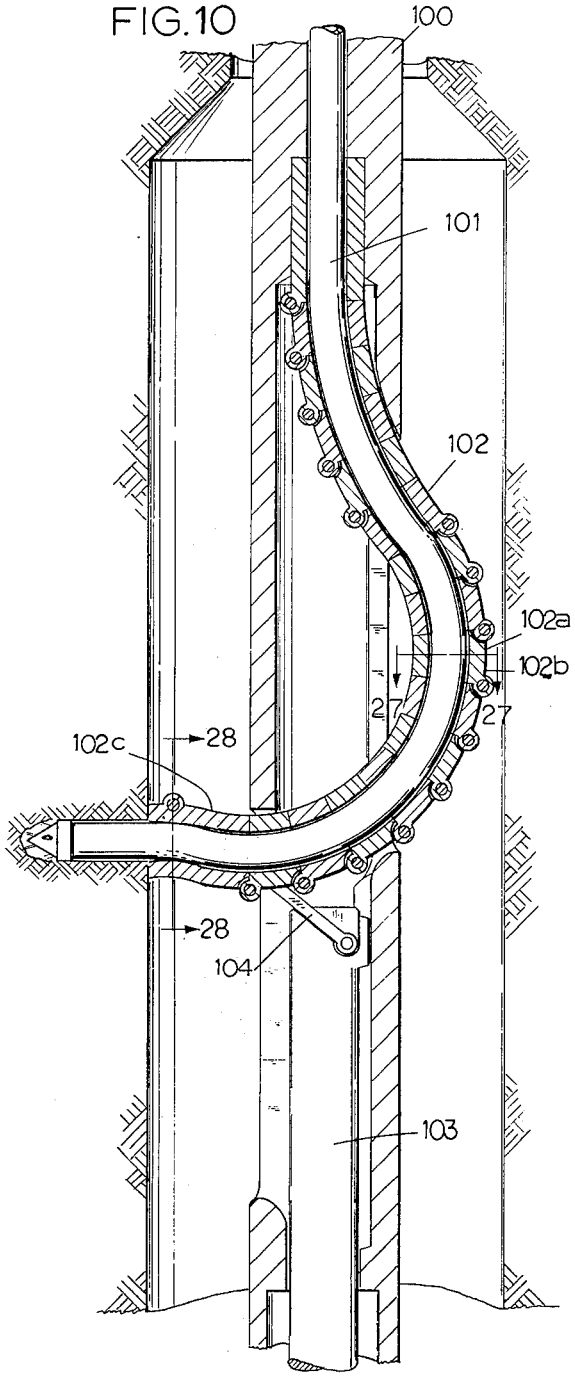
FIG. 10 is a view partly in section and partly in elevation of an alternate embodiment of the device of FIG. 8 deployed in an underreamed bore hole.

The device of FIG. 10 functions much as the device of FIG. 9, the principal difference being in the bendable conductor or guide. The device of FIG. 10 may be used with a flexible lateral drill string but is intended to facilitate the use of rigid lateral drill string whether the string is left in the lateral hole or recovered for reuse.

As drilling is to begin and ram 103 rises as described for the device of FIG. 9, the link 104 forces conductor 102 to curve to the limit of the excursion for which it is designed. Conductor 102 has links so shaped and hinged as to form a serpentine shape of the conductor so that lateral drill string 101 may bend within more of the full diameter of the bore hole, thereby accomplishing a specified total bend with longer radius than that accomplishable by the device of FIG. 9. For rigid lateral drill strings to be left in the hole, a larger diameter of string section can negotiate the curve of conductor 102 without breaking. For rigid lateral drill strings to be repeatedly used and recovered, a greater number of uses can be accomplished before fatigue failure.

Figure 27A:
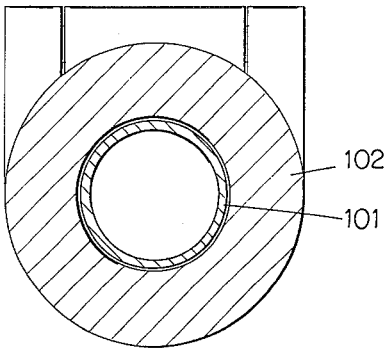
FIG. 27A is a transverse sectional view of a curvable conductor taken along line 27—27 of FIG. 10.
Figure 27B:
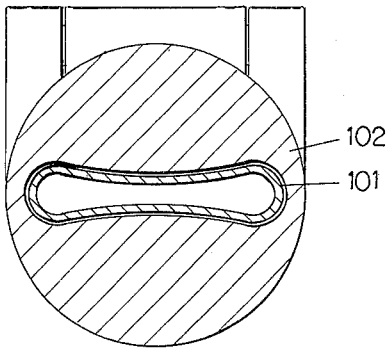
FIG. 27B is a transverse sectional view of an alternate shape of the device of FIG. 27A.
Figure 28:
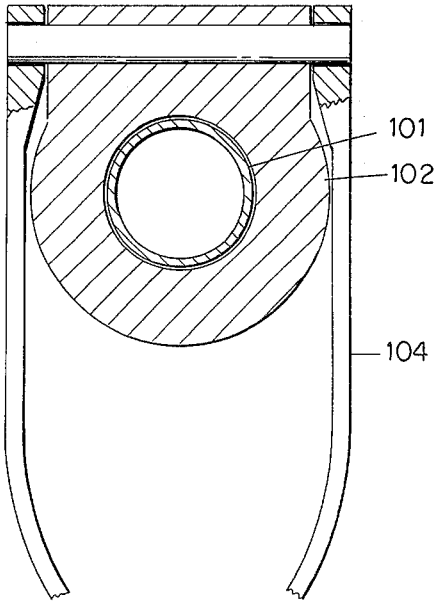
FIG. 28 is a transverse sectional view taken along line 28—28 of FIG. 10.

It is known that a rigid tube or pipe can be flattened in cross section and bent into a shorter radius about the lengthened transverse axis than could be non-destructively accomplished without flattening. The bendable conductor 102 may have links with longitudinal openings shaped as shown in FIG. 27*b*. As string 101 is forced through such links it is flattened and as the string is bent around the conductor and approaches the exit end, it is reshaped to be round as shown in FIG. 28. The exit bore die 102*a* reshapes the string round in cross-section and forces a reverse bend in the axis sufficient for the string to continue into the earth round and straight. The pipe 101 may be flattened before introduction into the device to emerge straight and round.

Figure 11:
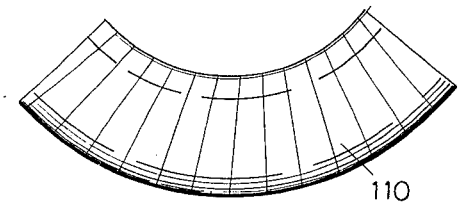
FIG. 11 is a view in elevation of a portion of the curved section of the bendable lateral drill string conductor of the embodiment shown in FIG. 2.
Figure 12:
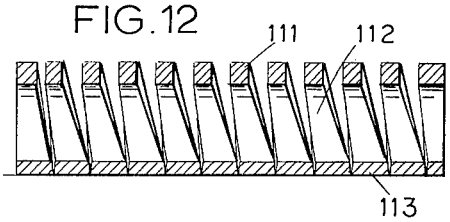
FIG. 12 is a longitudinal sectional view of a portion of the conductor of FIG. 11 bent straight.

FIG. 11 is a side view in elevation of part of the flexible portion of a bendable conductor made up of a helical spring. The spring wire is formed such that the spring is solid (loop against adjacent loop) until distorted by force and when solid has a curved axis. In order to reasonably balance the strain in the wire about the loop as the spring is forced straight, the cross section of the wire must vary with change in position of the section as viewed about the central axis of the coil. As viewed in FIG. 12, the top wire sections are nearer the center of curvature of the undistorted spring and are consequently shorter in the axial dimension than is the bottom of the loop. To retain approximately the same section modulus in torsion the top sections must be thicker in the transverse dimension than are the bottom sections. Since the helical spring is likely to be formed from a curved tube by cutting through the wall to form a helical pattern, the bore of the tube, drilled before bending and cutting, may be displaced radially from the axis of the outside surface to give a thicker wall on the inside of the curve. The result of producing a displaced bore, then bending and cutting into a coil as shown, is top wire sections 111 and bottom wire sections 113 of different shape, with the result that the curved helical spring may be forced straight with reasonably uniform distribution of torsional stresses over the length of the wire formig the helical spring.

Figure 15:
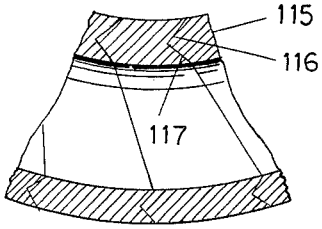
FIG. 15 is a sectional view, somewhat enlarged, of a length of the bendable conductor of FIG. 11 made of nesting wire section.

Side loads may tend to strain the bendable conductor into an undesirable contour as drilling takes place by a drill bit at the extending end of the bendable conductor. Therefore, the shape of the cross section of the wire making up the helical spring may need to serve a stabilizing purpose. As shown in FIG. 15, wire 115 has a male projection 116 which, when the wire loops are in solid contact, nests into a conforming female contour 117 on the abutting side of the adjacent wire loop.

The lateral drill string, in order to rotate about a curved axis and transmit axial thrust yet tend to remain straight when drilling, may need internal stiffening. Filament reinforced hydraulic pressure hose can be stiffened by internal pressure. Since the lateral drill string will transmit drilling fluid under pressure to the drilling end to supply fluid power, for instance, to a bit motor to supply fluid jets and to cool a drilling bit, an internal pressure will be normal to the operation. This internal pressure can be artificially increased to promote drill string stiffness by placing flow restrictions at the bit end to compel a suitably high pressure within the drill string at any fluid flow rate.

Figure 13:
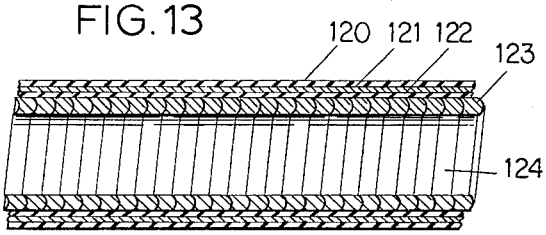
FIG. 13 is a longitudinal sectional view of a portion of the flexible lateral drill string of the preferred embodiment of FIG. 2.
Figure 14:
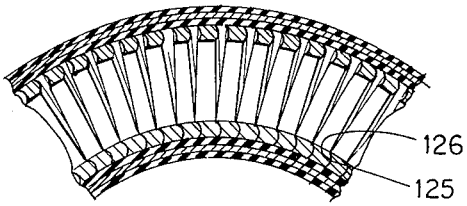
FIG. 14 is a sectional view of the portion of FIG. 13 when it is bent.

It is one of the features of this invention to provide a flexible drill string that can be readily bent to pass through a curved guide, but which will resist such bending and which will quickly straighten out when released from bending force. FIG. 13 is a longitudinal sectional view of one embodiment of such a flexible drill string. It includes outer jacket 120 of elastomeric material with woven wire reinforcing 121 embedded therein. Located inside the outer tube is inner pressure tube 122 of elastomeric material which encloses helical spring 123 of specially shaped wire designed to add stiffness to the spring. In the embodiment above square wire is used, having a convex side 126 and a concave side 125 that will mate when the spring is fully compressed. The spring is designed to be fully compressed as shown in FIG. 13 when the drill string is assembled. It is held compressed by the outer hose made up of tubes 122 and 120 and reinforcing 121 which will place these members in tension. End fittings (not shown) will hold the outer parts in tension and the inner coil in compression. The reinforced drill string may now be forced to bend as in FIG. 14. The outer parts must be stretched farther to accomplish the bend with a resulting tendency to urge a return to straightness. The side of the coil 124 nearest the center of the curve radius will pivot at each coil loop abutment with the convex side 126 in rubbing contact with the concave side 125. The coil will resist radial crushing and contribute to the axial stiffness of the lateral drill string.

Figure 16:
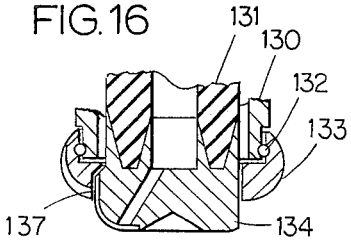
FIG. 16 is a longitudinal sectional view taken along line 16—16 of FIG. 17 showing a drill bit rotatably attached to the end of a bendable conductor with a lateral drill string and lateral drill bit nesting in the conductor drill bit.
Figure 17:
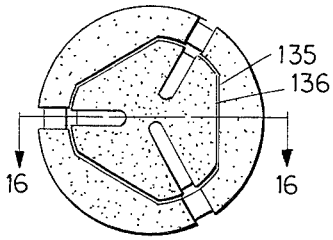
FIG. 17 is an end view in elevation of the conductor drill and nested lateral drill of FIG. 16.

When the bendable conductor has a rotatably attached drill bit to drill an access hole in the earth through which the lateral drill string must extend, the drill bit must have a center opening. The opening will not drill and a supplemental center drill is needed. This center drill is conveniently the drill at the end of the lateral drill string. By nesting the lateral drill string drill bit 134 in FIG. 16 in the conductor drill bit 133, the drill bit 134 may drive the bit 133 in rotation as well as drill out the earth at the center that bit 133 cannot drill. The shape of bit 134 must be such that it will not leave undrilled earth, that is, it should somewhat overlap the cutting path of bit 133. This is accomplished by shape 136 nesting inside recess 135 as viewed in FIG. 17. When conductor 130 has completed its drilling excursion with bit 133 rotating on bearings 132, drill string 131 continues advancing into the earth and bit 134 will emerge from recess 137 in bit 133. When bit 134 no longer engages the recess of bit 133 the bit 133 will cease to rotate and drill string 131 will proceed into the earth following and rotating bit 134 to the limit of the lateral hole drillng excursion. As shown in FIG. 16, the bit 134, upon being withdrawn from the lateral hole, will enter recess 137 and resist further retraction. This feature is a convenience, not a limitation. The bit 134 may be altered for insertion from above into the bendable conductor, pass into mating splines in bit 134, hold that position until the conductor hole is drilled, then proceed into the lateral hole drilling operation. Subsequently, the lateral drill string, bit and all, may be retracted through the conductor bit and the conductor.

Figure 18:
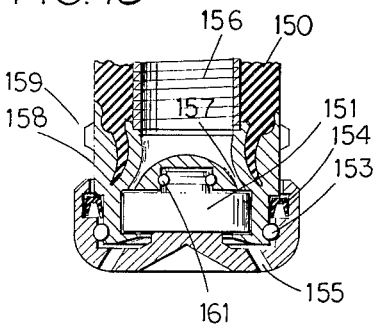
FIG. 18 ia a view partly in section and partly in elevation of the end of a lateral drill string with a rotably attached drill bit and a fluid powered drill bit driving motor.

The lateral holes drilled in the usual formation as a drain hole may be much smaller than the usual original bore hole. Smaller drill bits may be driven at high rotational speeds not compatible with rotational speeds of the flexing portion of the lateral drill string. A motor may be utilized at the end of the lateral drill string to rotate the drill bit as shown in FIG. 18. A fluid motor is shown. Drill string 150 has the stator attached to the drill string, the rotor being attached to the bit. Bearings 161 offer additional stability to the rotor. Fluid moving along opening 156 enters motor 151 by way of passages 157 causing the rotor to rotate. The exhaust fluid moves out the bit through opening 155. Leakage of fluid through bearing 153 is controlled by seal 154. The bit may be used to drive the conductor drill while it is inside the conductor drill. Alternatively, the conductor drill may be rotated by the lateral drill string 150 by means of optional lugs 159 on drill string terminal 158.

Figure 19:
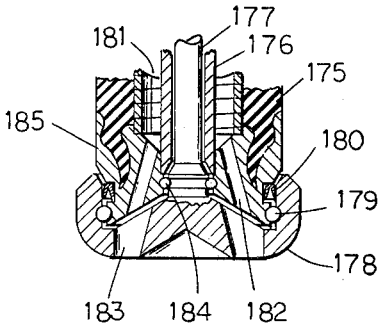
FIG. 19 is a view partly in section and partly in elevation of the device of FIG. 18 with the motor replaced by a flexible shaft.

An alternate means for driving the lateral drill string drilling bit above lateral drill string rotational speeds includes a flexible drive shaft extending through the bore of the lateral drill string. Such a device is shown in FIG. 19. The lateral drill string flexible end 175 has rotatably attached drill bit 178. The bit may rotate on bearings 179. Flexible drive shaft core 177 in sheath 176 extends through the bore of drill string 175 and is attached to drill bit 178 to drive it in rotation. Drilling fluid moves through bore 181, through channels 182 and out channels 183 in the bit. Shaft core 177 is stabilized by bearings 184. Leakage of drilling fluid between the conductor and the bit is controlled by seal 180. As in the device of FIG. 18, the conductor bit may be rotated by lugs (not shown) on lateral drill string terminal fitting 185.

Figure 20:
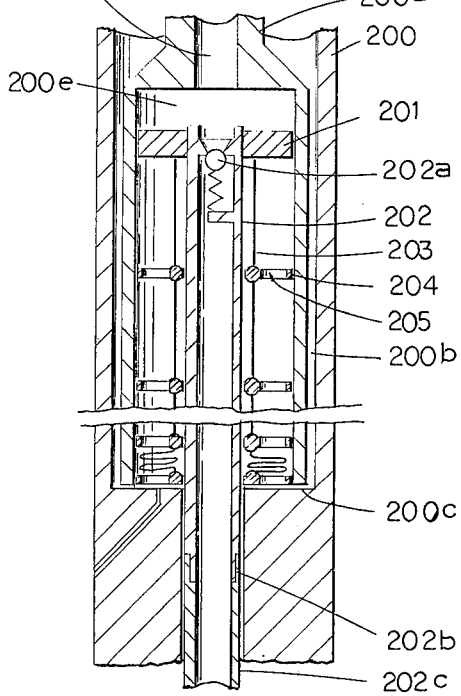
FIG. 20 is a longitudinal sectional view of a device to provide axial thrust to move a lateral drill string axially through the curved portion of the bendable conductor.

The lateral drill string usable with the invention may be made of rigid tubing to be forced down through the housing, around the bendable conductor and into the formation. The rigid string so used may be left in the lateral hole or recovered. The device of FIG. 20 is intended to provide the thrust to compel rigid pipe to perform the aforementioned action. Body 200 has hydraulic cylinder bore **200*e* affixed herein with a communicating opening 200*d* through the tube 200*a* capable of supplying fluid under pressure into cyliner bore 200***e* above piston 201.

Figure 22A:
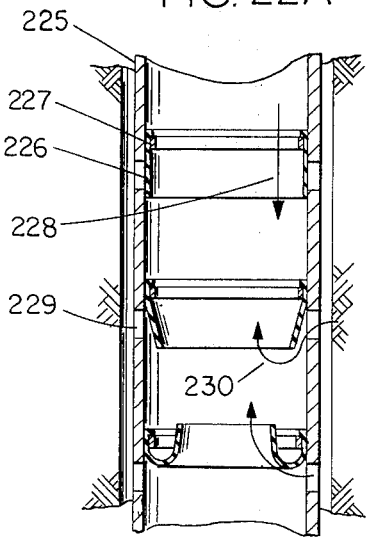
FIG. 22A is a longitudinal sectional view of a length of lateral drill pipe with side wall perforations and check valves.

Piston 201 is affixed to lateral drill string 202 to which axial thrust is to be applied. Since drill string 202 is usually a slender column prone to buckle under axial loads, support spiders 204 are distributed along the length of the bore of cylinder 200*e*. The spiders are slidably disposed about string 203 and are free to slide within the bore of cylinder 200*e*. The axial position of the spiders is established by flexible connector cables 203. Holes 205 prevent the spiders from being influenced by fluid flow. As fluid pressure is admitted to the top of cylinder 200*e*, downward pressure is applied to piston 201 which, in turn, urges string 202 downward. As the spiders 204 reach the bottom of cylinder 200*e*, cables 203 above each one reaching bottom will collapse. When the downward movement of string 202 is complete the reverse cycle is initiated by switching the fluid pressure from channel 200*d* to channel 200*b* by a control means (not shown). Fluid pressure entering the bottom of cylinder 200*e* through channels 200*c* will move piston 201 upward and string 202 will follow. As string 202 moves upward, the lower portion 202*c* may separate at slip joint 202*b* and remain in the earth. Slip joint 202*b* may be drawn into the bore of cylinder 200*e* if the stroke of piston 201 is quite long. Check valve 202*a* may be provided if this is expected so that piston 201 may be fully retraced upward. The check valve also makes possible the use of a perforated lateral drill string as shown in FIG. 22A and FIG. 22B when the drill string is to be recovered.

Figure 21:
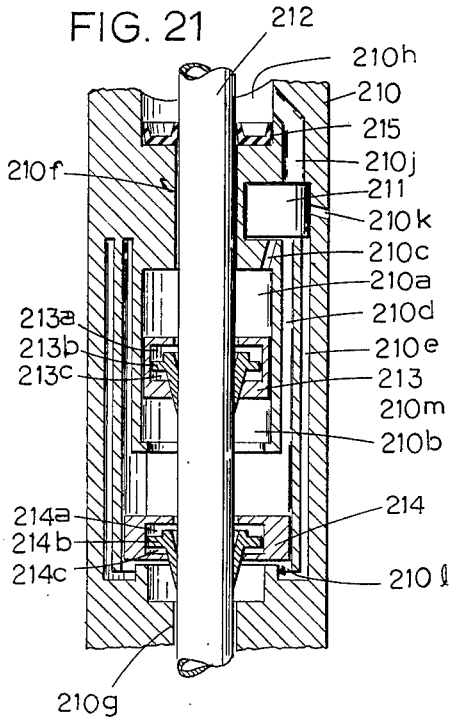
FIG. 21 is a longitudinal sectional view of an alternate reciprocating jack to push a rigid tube through a curved conductor.

In many cases it will be desirable to drop a series of lateral drill strings down the major drill string bore for insertion into the formation, to be left in the formation. This will avoid removing the device of the invention from the bore hole each time a lateral string is inserted and left in the formation. The device of FIG. 21 has body 210 to be attached to the manipulation drill string. Below the body 210 may be any of the bendable conductor systems herein described. A lateral drill string moves through seal 215 and down bore 210*f* through piston 213, through piston 214 and out bore 210*g* of body 210. The piston 213 contains slip 213*b* to grip the string 212 but will not grip until hydraulic pressure is applied, by processes to be described. Slip 214*b* likewise will not interfere with the downward movement of string 212 until pressure is applied. When drilling fluid pressure is applied to the major drill string bore, it is free to enter the bore of string 212 and is imposed also on opening 210*h* and is admitted through channel 210*j* to control valve 211. Valve 211 cycles fluid pressure to channels 210*c*, 210*d* and 210*e*. Such valve arrangements are commonly available and not shown here in detail. During one cycle, pressure is applied to channels 210*c* and 210*e*, channel 210*d* being connected through valve 211 to drain 210*k*. During this cycle pressure stands in cylinder opening 210*a* urging piston 213 downward and entering piston opening 213*a*, causing slip 213*b* to be pinched in a tapered seat to grip string 212. At the same time pressure in channel 210*e* enters the lower cylinder area 2101 urging piston 214 upward and also entering area 214*c* below slip 214*b*; urging the slip upward out of the pinching recess and allowing piston 214 to move upward free of drag on string 212. During the second cycle of valve 211, pressure is applied to channel 210*d* and channels 210*c* and 210*e* are connected to drain 210*k*. Pressure then enters area 210*b* and urges piston 213 and slip 213*b* upward and urges piston 214 and slip 214*b* downward. This cycling process causes the pistons 213 and 214 to alternately be moved up and down in opposite directions causing in turn string 212 to be moved downward through bore 210*g*. At some point the lateral drill string will be inserted into the earth to the desired extent. A slip joint as shown in FIG. 20 may be used to separate the upper portion of string 212 from that portion of string 212 to be left in the formation. The device of FIG. 21 will not move the string upward. A similar set of piston, however, may be added operating upward instead of downward, set into action by command from the surface. A device as shown in FIG. 20 may be used for the short upward motion needed to free string 212. Alternately a wire line may be lowered from the surface of the earth to grip and lift the upper portion of string 212.

Lateral drill strings left in the formation to facilitate drainage need to be perforated through the side wall. In the drilling and insertion processes, however, the drill strings need to be capable of conducting fluid under pressure to the drilling end of the string. This is accomplished by tubes as shown in FIG. 22A and FIG. 22B. The tube 225 has a plurality of side wall perforations 229. The bore of the tube is fitted with an elastomer tube 226 or a plurality of such tubes. The tube 226 is secured in the bore of tube 225 by rings 227 pressing the tube 226 outwardly against the inside wall of tube 225 to hold the two together. Rivets, bonding adhesives or other securing means, may replace band 227. When internal pressure exceeds external pressure, the tube 226 covers the perforations 229 acting as a check valve. Fluid introduced into the bore of the tube 225 will remain there to flow to the end as shown by arrow 228. When internal pressure is less than external pressure, the fluid entering perforations 225 will urge sleeve 226 inwardly allowing fluid to enter the bore and flow axially as shown by arrow 230.

Figure 22B:
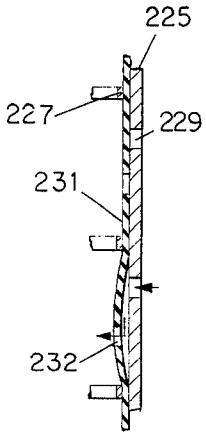
FIG. 22B is a longitudinal view of one sidewall of the perforated lateral drill pipe of FIG. 22A having a perforated inner tube.

The lateral drill string of FIG. 22B, shown with one wall only, functions much as the device of 22A except the elastomeric inner tube 231 is continuous in length over a perforated region. The inner tube 231 has perforations through the side walls not in registry with the perforations 229 in the outer tube 225. Again, fluid pressure inside the assembly is conducted to the end but fluid may enter from outside the tube at any perforation and flow through the inner tube perforations as shown at opening 232.

Figure 23:
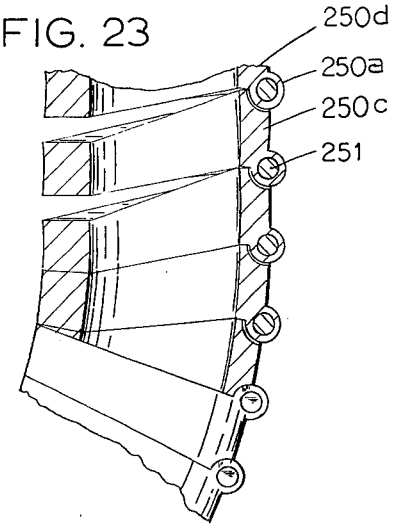
FIG. 23 is a view partly in section and partly in elevation of a helical bendable conductor with stiffening hinge attachments taken along line 23–23 of FIG. 24.
Figure 24:
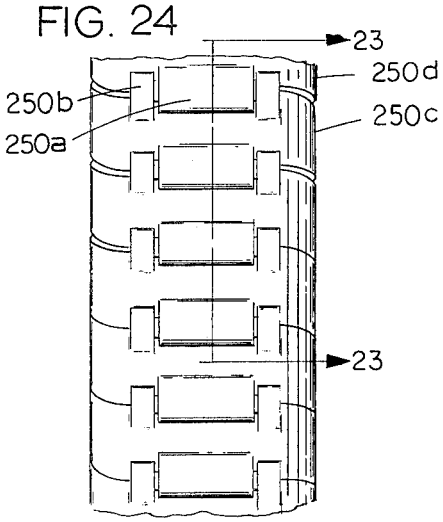
FIG. 24 is a view in elevation of a portion of a helical curved conductor having hinge means attached between turns on one side.

The device of FIG. 23 is a helical coil with hinge stiffeners. When used as a bendable conductor, the curved centerline should lie in an intended plane also containing the centerline of the lateral hole to be drilled. To constrain the bendable conductor to bend as above described, each wire loop has a hinge attaching it to each adjacent loop. Each loop then can move relative to adjacent hinge pin 251. The centerline of the hinge pin is perpendicular to a plane containing the curved centerline of the bendable conductor when it is curved. Hinge portion 250*a* is rigidly attached to loop 250*d*. Hinge portion 250*b* is rigidly attached to loop 250*c*.

Figure 25:
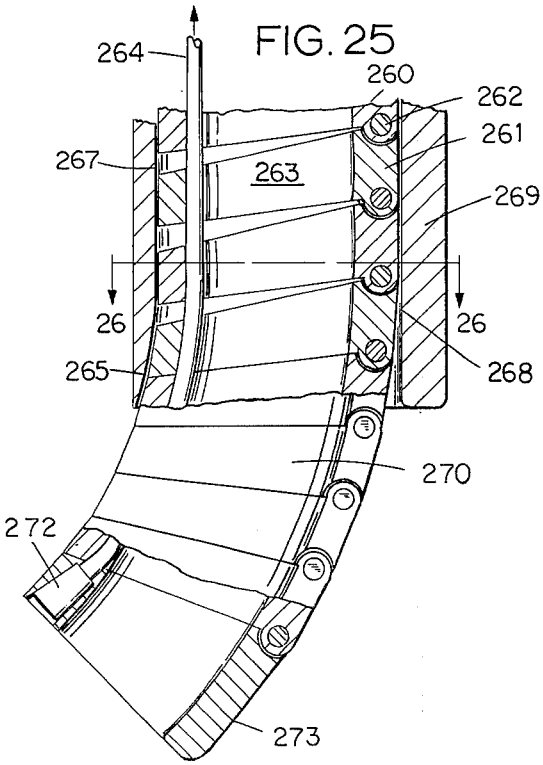
FIG. 25 is a view partly in section and partly in elevation of an alternate form of a bendable conductor and associated guide bore.
Figure 26:
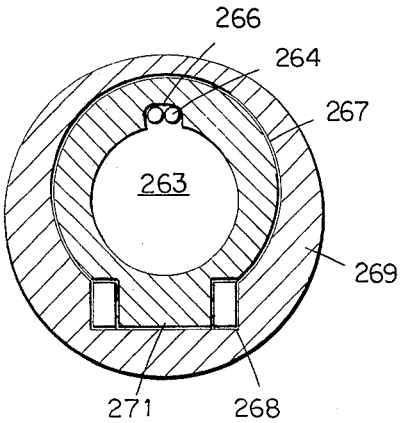
FIG. 26 is a transverse sectional view of the device of FIG. 25 taken along line 26—26.

In FIG. 25 and FIG. 26, a device usable as a flexible portion of a bendable conductor is shown. Individual links are used in chain fashion. Each link is hinge connected to the adjacent link so that each link may pivot relative to the adjacent link only about a hinge pin centerline. The bendable conductor 270 is shown partially extending from constraining housing 269. Housing 269 has longitudinal opening 267 with grooves 268 to accept the hinge projections 271 of conductor assembly 270. This opening 267 prevents rotation of the conductor relative to housing 269 so that the conductor, as it is pushed out of bore 267, will bend with the curved centerline of bore 263 in a stable plane. Opposite the hinges, a tension member 264 urges the links to curve about the hinge pin axes. The tension means (not shown), being resilient, will allow the conductor 270 to move out of opening 267 within reasonable ejection forces. Flexible tension member 264 is nested in groove 266 and is anchored by means 272 in the end link. Cam surface 265 acts upon each link emerging from opening 267 so that the extending conductor 270 follows a prescribed centerline. The lateral drill string (not shown) extends through opening 263. As hereinbefore described, a conductor drill bit may be rotably attached to the link 273 to drill a path for the extending conductor. Alternately, the lateral drill string bit may be piloted by the bore of link 273 to drill an access hole if needed. The bendable conductor may be used with rigid pipe serving as a lateral drill string.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be imployed without reference to other features and subcombinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, what is claimed is:

1. A device for drilling a hole in the side wall of an existing bore hole having an axis extending in a generally lateral direction from the longitudinal axis of the existing bore hole comprising; a housing for moving through the bore hole to the desired location for the lateral hole, said housing having a longitudinal bore and an opening, an inherently curved, resilient lateral drill string conductor located in the housing with a hollow drill bit rotatably attached to one end thereof, means for moving the conductor between a first position inside the longitudinal bore of the housing for movement with the housing through the bore hole to the desired location of the hole in the side wall, and a second position with a portion of the conductor bent so that it curves out of the opening in the housing to guide a drill string moving through the conductor and hollow bit to and into the side wall of the bore hole to drill a hole therein, a lateral drill string, a portion of its length being resilient, located in the housing, means to rotationally drive said hollow bit to drill an access hole for said conductor as said conductor extends from the first position to the second position, and means for moving the drill string through the conductor and hollow bit, from the housing to and into the earth when the conductor is in the second position to drill a lateral hole in the earth.

2. The device of claim 1 in which said conductor at least in part comprises a helical spring having a curved axis when in the unstrained state to provide said inherent curvature and resilience to achieve a tendency to bend into a preselected curve as the conductor extends from the first position to the second position.

3. The device of claim 1 in which the conductor includes a plurality of annular rings pivotally connected for alignment along a straight axis when in the first position and for forming a curved conductor when in said second position to guide the drill string into the side wall of the bore hole and resilient means to move the annular rings pivotally to provide said inherently curved, resilient characteristic to form a curve when in said second position.

4. The device of claim 1, further provided with means carried by the housing to engage the bore hole side wall to prevent motion of the housing relative to the bore hole during lateral drilling operations.

5. The device of claim 1 further provided with down hole means to synchronize the axial movements of conductor and lateral drill string so that the movements required to drill a lateral hole are carried out automatically.

6. The device of claim 1 in which said lateral drill string includes a drill bit rotatably attached to the end of said lateral drill string that extends into the side wall and a down hole motor to rotate said drill bit relative to said lateral drill string.

7. The device of claim 1 in which said means to drive said hollow bit includes means to rotate the hollow drill bit with said lateral drill string.

8. The device of claim 7, in which said lateral drill string includes means to engage the conductor drill bit to rotate the drill bit with the drill string to drill a hole in the side wall as the conductor moves from the first position to the second position, and means to rotationally disengage said drill string from said bit as said drill string advances through said conductor to drill a hole.

9. The device of claim 8, further provided with a down hole motor to rotate the lateral drill string.

10. A device for drilling a hole in the side wall of an existing bore hole having an axis extending in a generally lateral direction from the longitudinal axis of the existing bore hole comprising; a housing for moving through the bore hole to the desired location for the lateral hole, said housing having a longitudinal bore and an exit opening through which an inherently bent resilient tubular lateral drill string conductor can move, an inherently bent resilient lateral drill string conductor located in the housing, means for attaching a first end of the conductor to a control means reaching to the earth surface independently of any drill string which may be used, for moving the conductor from a first position inside the longitudinal bore of the housing to a second position in which the second end of the conductor extends from the housing to guide any appropriate drill string as it drills a hole in the side wall of the bore hole, whereby the conductor in the vicinity of the second end curves, in a preselected arc due to its inherently bent shape as it moves from the first position to the second position, the total angle traversed by said arc being proportional to the distance moved by said conductor in moving from said first position to said second position, said conductor having means to prevent rotation between the conductor and the housing, a generally central longitudinal bore extending through the conductor and housing through which an appropriate lateral drill string may move axially to drill a lateral hole.

11. The device of claim 10 further provided with a lateral drill string including a drill bit attached at one end, extending axially along the longitudinal bore of the housing and the conductor, control means for said lateral drill string extending to the earth surface, means to attach the lateral drill string to the control means, a portion of the length of the lateral drill string near the bit end being flexible to curve along the bore of the conductor.

12. The device of claim 11 further provided with a drill bit rotatably attached to said second end of said conductor, means to rotate said drill by a lateral drill string free to move through said bit to drill a hole in the earth to accept said conductor as the second end extends from the housing to and into the earth.

13. The device of claim 11 further provided with a down hole prime mover with a stator and a rotor, the rotor having an axially longitudinal bore through which a lateral drill string may move, means to lock the rotor to the drill string to prevent rotation relative thereto while allowing axial relative motion therebetween.

14. The device of claim 11 further provided with means at the second end of said conductor to axially guide a lateral drill string drill bit and apply axial thrust thereto such that the conductor in moving from the first to the second position may cause an access hole for said conductor to be drilled by said bit as the lateral drill string rotates and moves axially in unison with said conductor, the bit to be free to move axially away from the second end of said conductor to drill farther into the earth as the drill string rotates and moves axially through the conductor rotating the bit and applying thrust thereto.

15. The device of claim 11 further provided with means to rotatably mount said drill bit on said lateral drill string and a down hole motor to rotate said bit relative to said drill string.

16. A device for inserting rigid tubes into the earth in a generally lateral direction from an existing bore hole comprising a housing for moving through the bore hole to the desired location for the insertion of tubes into the side wall of the bore hole, said housing having a transverse opening and a longitudinal opening in which is situated a bendable conductor comprising a plurality of articulated conductor links in side by side arrangement with each link pivotally attached to the links adjacent thereto for relative movement of the links between a first position in axial alignment in the housing and a second position with a portion thereof curving out of the transverse opening of the housing, means for moving the conductor between said first and second position comprising means for pivotally attaching the end of the conductor to be bent to said housing for pivotal movement around axes transverse to the plane in which the conductor is bent, means for limiting the amount of pivot of the links so that the conductor will bend into the desired curve when moved to said second position, a rigid tube movable through said conductor, means to move a tube through the conductor when in said second position and means to straighten said tube as it emerges from said conductor to insert the straightened tube into the side wall of the bore hole.

17. The device of claim 16 in which said rigid tube to be inserted laterally into the earth has a plurality of perforations through the side wall and a check valve associated with each perforation to permit fluid to move from outside the tube, through the perforations in the side wall into the tube bore, and prevent the flow of fluid from the bore of the tube through the perforations so that fluid entering the tube cannot flow out of the tube through the perforations.

18. The device of claim 16 further provided with means at the end of said rigid tube which extends into the earth to drill a hole for said tube as said tube extends into the side wall.

19. A device for drilling holes, extending in a generally lateral direction from an existing borehole, into the side wall of the existing borehole comprising; a housing, a guide with an axial channel for a lateral drill string one end of which is curved so that the end has a channel axis directed to approach the side wall generally lateral to the bore hole axis, a lateral drill string at least part of its length being flexible, capable of passing axially along said drill guide channel said flexible length being comprised of a helical coil and a filament reinforced resilient hose, said coil being formed of wire of such contour that the loop adjacent surfaces nest in the adjacent loop surface when the coil is axially compressed solid, said filament being held in tension, said tension being transmitted to said coil to compress said coil by end fittings transmitting axial forces to both filament and coil so that said coil will sustain an axial load without column buckling yet bend around said guide to extend into the side wall to drill a lateral hole.

* * * * *